United States Patent [19]

Guillem et al.

[11] 4,206,917

[45] Jun. 10, 1980

[54] SPORTS RACQUET

[76] Inventors: Guy Guillem, 75 rue Mal Foch; Rene A. Vinci, 1, rue des grives, both of 66000 Perpignan; Gilbert C. Roche, 4 rue des Bois, 95520 Osny, all of France

[21] Appl. No.: 947,640

[22] Filed: Oct. 2, 1978

[30] Foreign Application Priority Data

Oct. 14, 1977 [FR] France ..... 77 31865

[51] Int. Cl.[2] ..... A63B 49/00

[52] U.S. Cl. ..... 273/73 E

[58] Field of Search ..... 273/73 E

[56] References Cited

U.S. PATENT DOCUMENTS

| | | | |
|---|---|---|---|
| 360,468 | 5/1887 | Phelps | 273/73 E |
| 2,034,444 | 3/1936 | Rauch et al. | 273/73 E |

*Primary Examiner*—Charles E. Phillips

*Attorney, Agent, or Firm*—Kerkam, Stowell, Kondracki & Clarke

[57] ABSTRACT

The strings of a tennis racquet are tensioned by passing over a liquid-containing flexible tube in the frame of the racquet with means provided in the handle of the racquet for providing pressure to the liquid in the tube to increase or decrease the tension of the strings.

11 Claims, 8 Drawing Figures

SPORTS RACQUET

BACKGROUND OF THE INVENTION

The invention relates to racquets and mainly to tennis racquets.

The gut stringing network of a racquet is generally attached directly to the frame and no means of adjusting the tension is provided. But the tension depends in particular on the hygrometric conditions and the air temperature and varies in the course of a match, during which the strings slacken.

The invention proposes a simple means for precise and easy adjustment of the tension of the stringing.

SUMMARY OF THE INVENTION

According to the present invention we provide a racquet comprising a frame provided with a pheripheral groove, in the head of the racquet, a liquid-containing flexible tube deformable by the pressure of the liquid therein, the said tube being disposed in relation to the stringing so that the tension in the stringing applies a crushing force to the said tube, means for subjecting the liquid in said tube to a superatmospheric pressure, and resilient means for damping the pressure changes in said tube due to sudden variations in the tension of the stringing by the impact of a ball.

Preferably, the support of the strings on the deformable envelope is indirect and is effected by means of several elongate members, mounted slidably in the peripheral groove of the frame and provided with means for securing the stringing to said at least one member.

Advantageously, the elongated components are mounted end to end in said peripheral groove, each one being held independently in the groove by the cooperation of projections along their base with openings arranged in the frame, wherein the strings traversing bores which terminate at the end of the said projections, and the said components are profiled so as to form a bearing surface for the said deformable tube which is thus held between the said component and the bottom of the groove. More advantageously, there may be two such deformable tubes extending side by side along said groove. In the latter case the said elongate members may be T shaped with the vertical stem of the T extended by said projections which are cylindrical, and the horizontal bar of the T having a lower surface shaped so as to constitute two bearing surfaces which form two continuous grooves which receive and bear on the two deformable tubes.

The means for pressurising the liquid comprising a hydraulic, pneumatic or hydro-pneumatic pressure adjustment device mounted in the racquet handle.

BRIEF DESCRIPTION OF THE DRAWINGS

In order that the present invention may more readily be understood the following description is given, merely by way of example, with reference to the accompanying drawings, in which.

DESCRIPTION OF THE PREFERRED EMBODIMENTS

Figure 1:
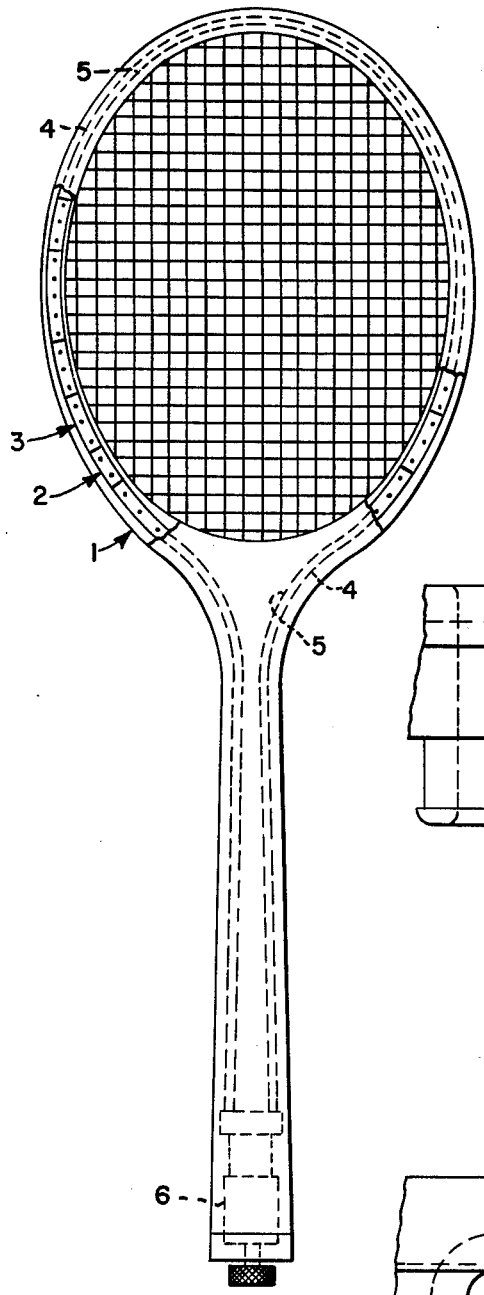
FIG. 1 is an elevation of a racquet with tension regulating means, in accordance with the invention.

FIG. 1 shows a racquet the frame of whose head is provided along the whole of its circumference with components 1, 2, 3 which serve to determine the tension of the stringing. As will be seen below, these components are placed end to end along the circumference of the head frame and bear on two deformable fluidfilled tubes 4 and 5 which themselves are in contact with the bottom of a groove 7 formed on the radially outer side of the frame.

The pressure in tubes 4 and 5 is controlled by means of a hydraulic actuating cylinder 6 to whose chamber the two tubes 4 and 5 are connected at their free ends. The various strings of the racquet head are connected to components 1, 2, 3 whose position, in relation to the frame, is thus determined by the value of the pressure in tubes 4, 5.

Figure 2:
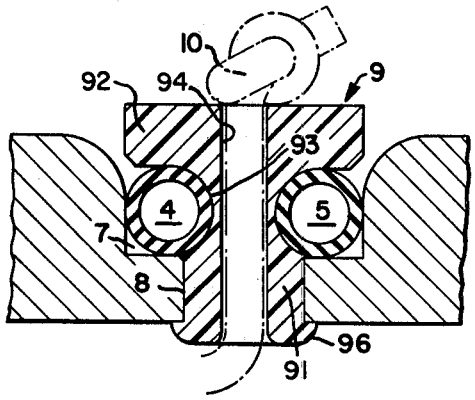
FIG. 2 is a detail, in cross sectional form of the racquet frame and of the adjusting means.

FIG. 2 shows one of these components 1, 2 or 3, here referenced 9, in a cross section taken at right angles to the frame. It will be seen that at the bottom of the groove 7 the frame has an opening 8 into which engages a cylindrical projection 91 of the component 9.

Figure 3:
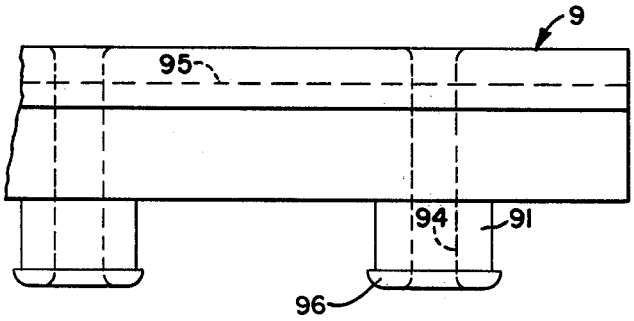
FIG. 3 is a detail, in elevation, of one of the tension adjusters for the stringing.
Figure 4:
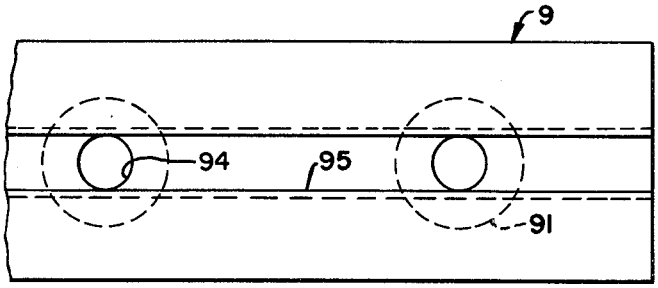
FIG. 4 is a plan view of the detail of FIG. 3.

FIG. 3 is an elevational view and FIG. 4 a plan view, of component 9. It will be seen that it has a T shaped profile. The arm cross-bar of the T is in the form of a strip 92 whose lower surface defines, with the hollowed part 93 of the vertical stem, two cylindrical bearing surfaces for the tubes 4 and 5. At the bottom end of these bearing surfaces the stem of the T is extended downwardly by several spaced cylindrical projections 91 to be received in corresponding cylindrical holes in the racquet frame. A respective bore 94 arranged along the axis of each projection 91 traverses the component 9 from side to side. As shown in FIG. 3, a racquet string 10 extends through bore 94 and is knotted at the end of the bore 94 on the radially outer side of the frame.

The various components 9 each comprise one or several bores 94 coaxial with their corresponding cylindrical projections 91 which engage in the openings arranged for this purpose in the bottom of the groove of the frame. To obtain a uniform distribution of the tension in the strings 10 along the periphery of the frame, generally several models of components 9 of different lengths are used, having for instance, between one and five channels.

Preferably, as shown in FIGS. 3 and 4, the stringing may be recessed in a cylindrical groove 95 arranged on the upper surface of strip 92. This groove 95 facilitates the positioning of the stringing during assembly and ensures protection in the case of impact with the ground of the court.

The outer side of projection 91 is advantageously provided with a continuous or discontinuous undercut moulding 96 (FIGS. 2–4) forming an engagement catch. Before the strings 10 are inserted, component 9 is only retained by the engagement of the projection(s) 91 in the corresponding openings of the frame. As this engagement must make it possible for component 9 to be displaced along the frame, i.e. perpendicularly to the surface of the frame bottom, it is useful to provide means for locking the projections in the course of assembly of the racquet.

By way of example, the components 9 are made of a rigid plastics material.

Tubes 4 and 5 are made of a flexible plastics material. Their maximum diameter is in this case 3.2 mm. When the pressure obtaining within the two tubes 4 and 5 varies between 20 and 30 bars, the distance between the lower face of the small plates and the bottom of the groove varies between 2 and 3.2 mm. Such tubes may without difficulty withstand permanent pressures of 40 bars and brief pressure peaks as high as 200 bars.

The stringing may be attached in the usual manner, that is to say that a single gut string 10 forms the whole stringing network and successively passes through oppositely arranged bores 91 in pairs situated respectively on the two sides of the frame. The length of the string portion between these two opposite bores may thus sustain a variation of $1.2\times2=2.4$ mm, depending on the pressure in the tubes 4, 5.

During impact of the ball on the stringing, the impacted strings transmit the pressure variation which they sustain over the whole length of the tubes, so much so that the other strings themselves are subjected to this pressure variation. Thus the device serves as a tension distributor; all the strings are working during the impact of the ball with all the advantages driving therefrom.

As a variation, one may use two separate strings, each forming a respective complete network; the arrangement will preferably be such that the tensions of the two networks are substantially different from each other.

For this purpose, the tension control members may comprise two components sliding with respect to each other, each bearing on a respective one of the tubes 4, 5, the tube in question being connected to a respective one of two tension control devices. Such an arrangement may provide different characteristics for the forehand and backhand strokes.

It is also possible to let the two strings pass to the same bore 91 whilst imparting to them, during assembly, different tensions; the adjustment of the pressure in the tubes 4, 5 then effects a variation in each of these initial tensions by the same amount.

The tubes 4, 5 are pressurised by known hydraulic, pneumatic or oleo-pneumatic devices. The device must comprise some means of ensuring a certain suppleness for the stringing (a spring, a gas buffer, or elasticity of the tubes or of the walls of the fluid reservoir) and means for damping the impact shock to determine the ball "touch" and absorb a part of the induced vibrations which would usually be transmitted to the player's arm. This damping may be obtained by interposing, in the path of the liquid or liquids, one or several calibrated openings which retard the energy transmission.

Figure 5:
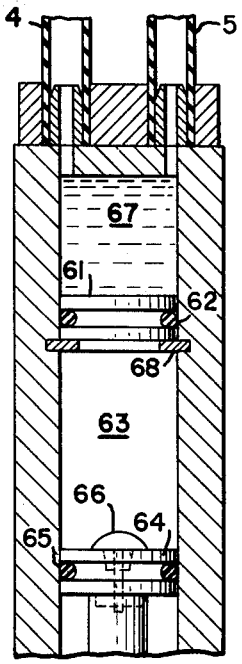
FIG. 5 shows schematically one form of pressure adjustment cylinder.

FIG. 5 shows a hydraulic actuating cylinder mounted, for instance, in the racquet handle. Piston 61, surrounded by sealing ring 62 is biased by compressed air contained in a chamber 63 whose volume is itself variable under the effect of a further piston 64 provided with a sealing ring 65.

The control piston 64 is actuated by means which have not been shown comprising a milled adjustment wheel and a non-return valve 66 in the piston rod. Rotation of the wheel will exert a screw jack effect on the piston 64 to increase or reduce the pressure in chamber 63. If the piston 64 is advanced to the end of its travel (i.e. to stop ring 68) without achieving a sufficiently high tension in the stringing then the piston 64 must be withdrawn to the full extent, by rotation of the control wheel, to induce more air into chamber 63 by way of valve 66, before the chamber 63 is recompressed.

The outlets of the liquid chamber 67 connected to tubes 4, 5 have been shown in FIG. 5. A calibrated opening, not shown, in the liquid path determines the damping. During the assembly of the stringing, a pressure of, for example, 20 bars is established in chamber 63 and the actuating cylinder is set with the piston 61 in its low position determined by the stop ring 68 serving as a stop ring. The tubes 4 and 5 will then be relatively flat. The tension adjustment is effected by raising piston 61, that is to say, by injecting into the tubes 4, 5 an additional volume of liquid which may at most be that of chamber 67 that is to say, 1.4 $cm^3$ in this instance. This volume corresponds to the maximum expansion of the tubes. Each impact of the ball produces a temporary displacement of the piston 61 towards the handle end of the racquet shaft. The compressed air buffer in chamber 63 may be replaced by or supplemented by a spring.

Figure 6:
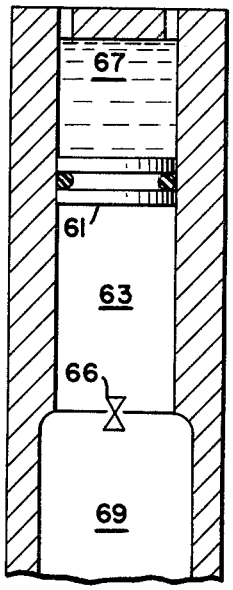
FIG. 6 illustrates a variant of the pressure adjustment cylinder.

FIG. 6 shows an alternative form of the device in which the liquid in the chamber 67 which is in communication with tubes 4 and 5 is urged into the tubes by the effect of which itself is pushed by a gas, for example, carbon dioxide, in a container 69 behind piston 61.

The valve 66 is operable to control the passage of the gas into the chamber 63 towards piston 61, and allows the pressure in the tubes to be regulated.

The device of FIG. 6 may be modified by abolishing piston 61; the gas of the container 69 will then mix with the liquid in chamber 67.

Figure 7:
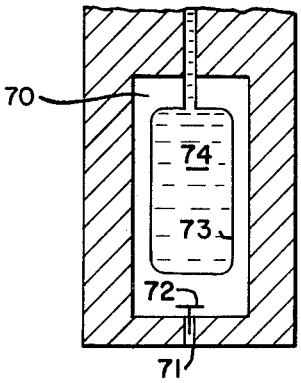
FIG. 7 shows a simplified pressure adjustment device.

A very simple embodiment has been shown in FIG. 7, in which a cavity 70 arranged in the racquet handle receives a gas pumped in through an opening 71 which communicates the cavity 70 with the outside of the handle via a non-return valve 72. A reservoir 73 with an elastic wall is housed in the cavity 70 and permanently contains a liquid 74 in communication with the tubes 4 and 5. The elasticity necessary for damping is provided by the wall of the reservoir 73 while the gas surrounding it determines the liquid pressure and hence the tension in the stringing.

It goes without saying that the arrangement of the stringing, and the construction of (a) the deformable means, (b) the means of introducing the fluid under pressure and (c) the means for attaching the stringing may be varied without departing from the spirit of the invention as defined by the following claims.

In particular, in order to reduce cost the stringing may be anchored directly on the deformable envelope which, for this purpose, will comprise a sufficiently strong wall section.

The stringing may now be secured to the frame so that it bears on the envelope whose deformation then no longer modifies the point of anchorage but instead the length of the run of each string between the anchorage point and the bottom of the frame section.

Figure 8:
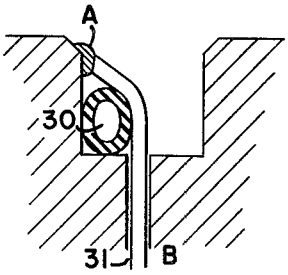
FIG. 8 illustrates a variant of the string anchorage means.

FIG. 8 gives a schematic outline of such a construction. A single deformable tube 30 has been shown. Cord 31 is attached to the frame at A and penetrates at B into an opening arranged in the bottom of the frame. The length of run AB of the string is varied by the deformation of tube 30.

What we claim is:

1. A racquet comprising a frame provided with a peripheral groove, in the head of the racquet, a liquid-containing flexible tube deformable by the pressure of the liquid therein and located in said groove the said tube being disposed in relation to the stringing so that the tension in the stringing applies a crushing force to the said tube, means for subjecting the liquid in said tube to a superatmospheric pressure, and resilient means for damping the liquid pressure changes in said tube due to sudden variations in the tension of the stringing caused by the impact of a ball, wherein said means for subjecting the liquid to a superatmospheric pressure comprises a hydraulic pressure adjustment device located in the handle of the racquet and capable of being operated by the user to vary the liquid pressure in said tube and thus to adjust the tension of the stringing.

2. A racquet according to claim 1, wherein the strings bear directly on the deformable tube and are fixed to the frame.

3. A racquet according to claim 1, and including a plurality of elongate members carrying flanges which are intended to engage in openings in the frame and being provided with bores for the strings of said stringing.

4. A racquet according to claim 3, wherein the elongate members have a T shaped profile whose horizontal bar has a lower surface shaped so as to constitute a bearing surface in the form of a rounded groove for the flexible tube thus held between said elongate member and the floor of said peripheral groove.

5. A racquet according to claim 3, wherein there are two said deformable tubes disposed side by side along said peripheral groove.

6. A racquet according to claim 1, wherein the pressure adjustment device is a hydraulic actuating cylinder having two pistons enclosing between them a closed chamber housing the resilient damping means, one of said pistons being actuated from outside the handle for the adjustment of the pressure.

7. A racquet according to claim 5, wherein the said resilient damping means is air or a compressible gas in said chamber.

8. A racquet according to claim 1 wherein the pressure adjustment device is a hydraulic actuating cylinder comprising a piston, and a pressure chamber which is supplied with gas from a pressurised container.

9. A racquet according to claim 1, wherein the pressure adjustment device is a reservoir with an elastic wall containing the incompressible liquid and housed in a cavity of the racquet handle, said cavity serving as a pressure chamber and being pressurisable by way of an opening from outside the handle.

10. A racquet according to any one of the preceding claims and including at least one calibrated orifice in the pressurising means or the flexible tube to constrict the flow of liquid induced by a change in the string tension.

11. A racquet according to claim 1 wherein said resilient damping means is effective to spread the pressure variations in the flexible tube to effect the entire stringing.

* * * * *